US007877902B2

(12) United States Patent
Pieriboni

(10) Patent No.: US 7,877,902 B2
(45) Date of Patent: Feb. 1, 2011

(54) FOOTWEAR WITH VARIABLE CONFIGURATION HEEL

(76) Inventor: Antonio Pieriboni, Via A. Volta, 32/5, Montebello Vicentino (VI) (IT) I-36054

( * ) Notice: Subject to any disclaimer, the term of this patent is extended or adjusted under 35 U.S.C. 154(b) by 810 days.

(21) Appl. No.: 11/667,723

(22) PCT Filed: Nov. 17, 2005

(86) PCT No.: PCT/IB2005/003451

§ 371 (c)(1),
(2), (4) Date: May 31, 2007

(87) PCT Pub. No.: WO2006/054157

PCT Pub. Date: May 26, 2006

(65) Prior Publication Data

US 2007/0289167 A1 Dec. 20, 2007

(30) Foreign Application Priority Data

Nov. 19, 2004 (IT) ..... VR2004A0179

(51) Int. Cl.
*A43B 3/24* (2006.01)
*A43B 21/36* (2006.01)

(52) U.S. Cl. ..... 36/100; 36/34 R; 36/81; 36/42

(58) Field of Classification Search ..... 36/100, 36/105, 34 R, 42, 24.5, 81

See application file for complete search history.

(56) References Cited

U.S. PATENT DOCUMENTS

| | | | | |
|---|---|---|---|---|
| 3,464,126 | A | 9/1969 | Sarkissian | |
| 3,805,418 | A * | 4/1974 | Matuka et al. | 36/34 A |
| 4,146,981 | A * | 4/1979 | Renaldo | 36/100 |
| 4,416,072 | A | 11/1983 | Sarkinssian et al. | |
| 4,670,996 | A * | 6/1987 | Dill | 36/42 |
| 4,805,320 | A * | 2/1989 | Goldenberg et al. | 36/42 |
| 4,910,885 | A * | 3/1990 | Hsieh | 36/37 |
| 5,309,651 | A | 5/1994 | Handel et al. | |
| 5,524,365 | A * | 6/1996 | Goldenberg | 36/42 |
| 5,953,836 | A * | 9/1999 | Watt et al. | 36/42 |
| 6,021,586 | A | 2/2000 | Bucalo et al. | |
| 7,140,125 | B2 * | 11/2006 | Singleton et al. | 36/38 |

FOREIGN PATENT DOCUMENTS

| | | |
|---|---|---|
| EP | 1 118 282 | 7/2001 |
| FR | 926 391 | 9/1947 |
| FR | 2 844 157 | 3/2004 |
| GB | 2 200 030 | 7/1988 |

OTHER PUBLICATIONS

International Search Report mailed Feb. 24, 2006.

* cited by examiner

*Primary Examiner*—Jila M Mohandesi
(74) *Attorney, Agent, or Firm*—Laubscher & Laubscher, P.C.

(57) ABSTRACT

A footwear comprises a sole and a heel provided with a first heel portion fixed to said sole, said heel comprising a second heel portion, rotatable around a hinge device and adjustable from a first position, in which said second heel portion protrudes transversely from said sole, to a second position in which said second heel portion is rotated to said sole; a footwear comprises a sole provided with a heel, and a support portion connected to said sole on which a further heel is obtained shaped to supportingly receive said heel.

6 Claims, 8 Drawing Sheets

FOOTWEAR WITH VARIABLE CONFIGURATION HEEL

This application is the National Stage application of PCT International Application No. PCT/IB2005/003451 filed on 17 Nov. 2005. PCT/IB2005/003451 claims priority to IT Application No. VR2004A000179 filed on 19 Nov. 2004. The entire contents of these applications are incorporated herein by reference.

The present invention relates to female footwear the special feature of which is that of being provided with a variable configuration heel.

More particularly, the present invention refers to footwear of the sandal type that is provided with a heel provided with elements that enable it to be taken from a raised or walking position to a lowered or rest position.

The invention proposes sandal footwear that enables the person wearing it to be able to use an accessory that provides a dual use mode: a first walking use mode, in which the heel remains firmly raised to its entire upward extent and a second use mode in which the heel is retracted inside so as to lower its height and make the footwear more comfortable for the foot. The present invention can be applied in the field of fashion and in particular in the sector of typically female footwear.

PRIOR ART

It is known in the footwear industry that stylists have always endeavored to produce footwear with the most varying shapes dictated in certain cases by the taste of fashion and in others by practicality and comfort in wearing such an item of clothing.

It is also noted that elegance in most cases is not matched by practicality and comfort and in particular, with reference to female footwear, heels and above all high heels, are always very uncomfortable to wear and force the person wearing such footwear to have a gait that from one point of view may be fascinating but from another point of view causes a certain amount of suffering. This discomfort of footwear with a heel and above all the discomfort caused by high heels is resolved by the relief of the woman wearing them only when she removes the footwear.

DISCLOSURE OF THE INVENTION

The present invention proposes to provide female footwear that is able to eliminate or at least reduce the inconvenience indicated above through the use of a heel of the variable configuration type.

The invention proposes more precisely to provide footwear provided with a variable configuration heel that is able to provide female customers with a dual function: a first walking configuration in which the heel is positioned extending to its full height and a second configuration in which the heel is lowered to a rest position. This is obtained by the use of the footwear with a variable configuration heel the features of which are disclosed in the main claim. The dependent claims of the solution in question indicate embodiments of the invention.

In a first aspect of the invention, there is provided footwear comprising a sole, and a heel comprising a first heel portion fixed to said sole, wherein said heel comprises a second heel portion, rotatable around a hinge means device and adjustable from a first position, wherein said second heel portion protrudes transversely from said sole, to a second position wherein said second heel portion is rotated to said sole.

In a second aspect of the invention, there is provided footwear comprising a sole provided with a heel, wherein it furthermore comprises a support portion connected to said sole on which a further heel is obtained shaped to supportingly receive said heel.

The main advantages of this solution, in addition to those that arise from the constructional simplicity, relate above all to the fact, that as has been shown previously, a woman who uses an accessory according to the invention can take advantage of its dual function, satisfying on the one hand the need dictated by elegance and on the other hand the practicality of the footwear, which is ensured once its rest configuration has been set.

A further advantage offered by the present invention is the one by which to move from the raised configuration to the lowered or rest configuration, no removal of pieces is necessary or any screwing or unscrewing of components.

Furthermore, the conformation according to the invention enables the footwear to have a very aesthetically pleasing and elegant appearance, both in the raised and in the lowered configuration.

The footwear according to the invention is thus provided with a rear part in which a variable configuration heel is fitted, which substantially consists of a fixed sector or first heel portion, applied at the rear part of the sole, with which a movable sector or second heel portion with adjustable positioning is associated that is suitable for enabling the heel to be moved from a raised position to a lowered rest position. What enables the movable portion of the heel to remain connected to the fixed portion is a hinge the horizontal axis of which is arranged perpendicularly to the longitudinal axis of the footwear.

ILLUSTRATION OF THE DRAWINGS

Other features and advantages of the invention will become clear from reading the following disclosure of an embodiment of the invention provided by way of non-limitative example with the help of the drawings illustrated in the attached tables, in which.

DISCLOSURE OF AN EMBODIMENT OF THE INVENTION

Figure 1:
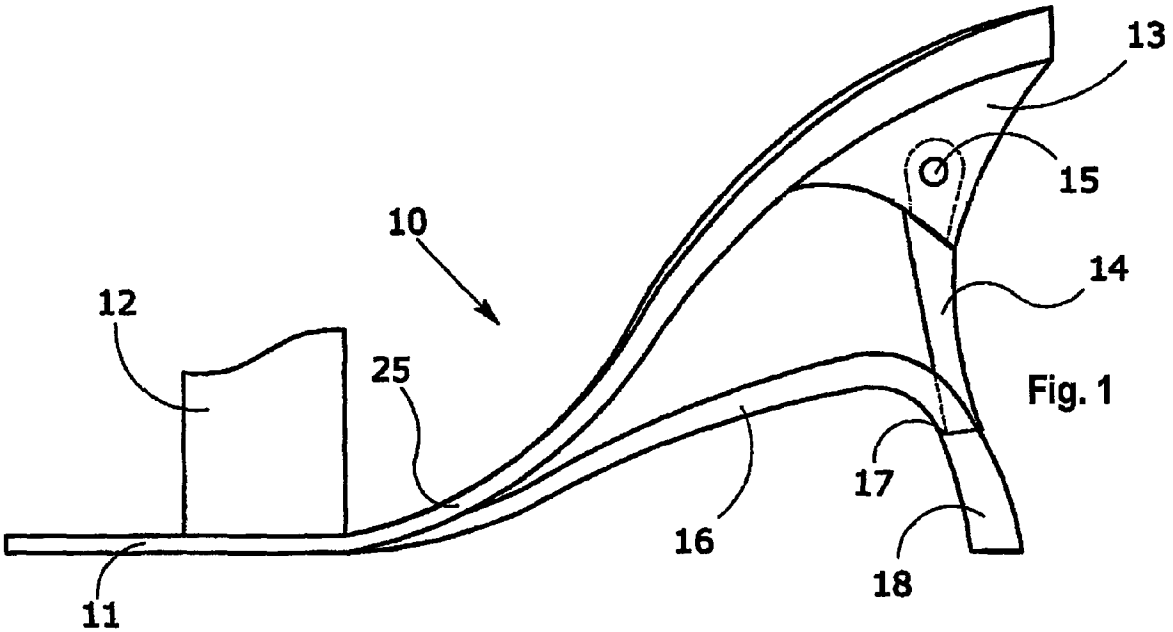
FIG. 1 is a lateral schematic view of the sandal footwear according to the invention in a raised position and position for use at maximum height.

With reference to the enclosed figures, the footwear according to the invention with variable configuration heel, totally indicated by 10, comprises a sole 11 associated with uppers 12, which sole, at its rear part, is affected by the presence of a particularly shaped heel, i.e. formed by a fixed part, or first heel portion 13 and by a movable part, or second heel portion 14.

The first heel portion 13 of the heel in fact has a seat in which a pin 15 with a horizontal axis is inserted that is arranged transversely, i.e. orthogonally, to the longitudinal axis of the footwear.

The second heel portion 14 is associated with the fixed portion through said horizontal pin 15, and in such a way that with the angular movement of the movable part, a variation in heel height is caused.

Figure 2:
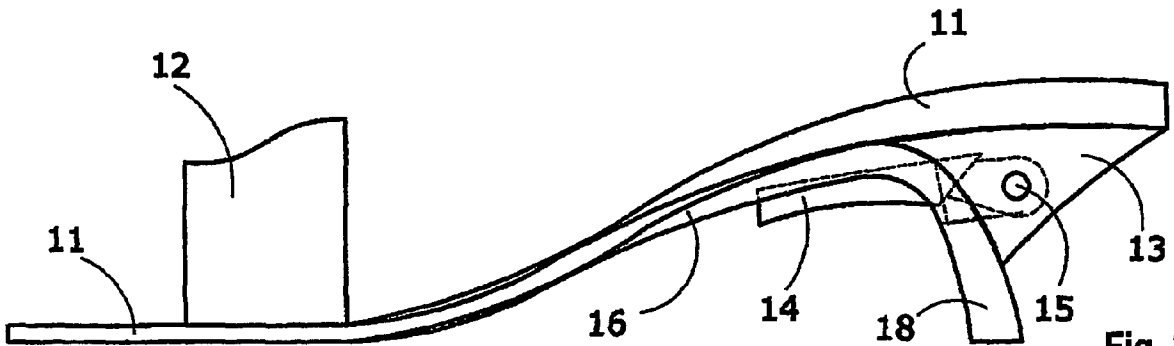
FIG. 2 shows the footwear of the preceding figure, but in a lowered or rest position, with the heel folded inside.

As shown in FIGS. 1 and 2, the sole of the footwear furthermore, at the lower part, has an arched bridge or fork 16 that goes from the median zone of the sole and ends at the lower part of the heel. The arched bridge 16 may be of any shape, although it is possible that it is a double fork arrangement that, at the lower end of the second heel portion 14, has a seat 17 with a shape suitable for enabling the housing of the movable end of the heel and its being retained in a raised position whereas an end 18 of the fork constitutes the heel's support point on the ground.

Figure 14:
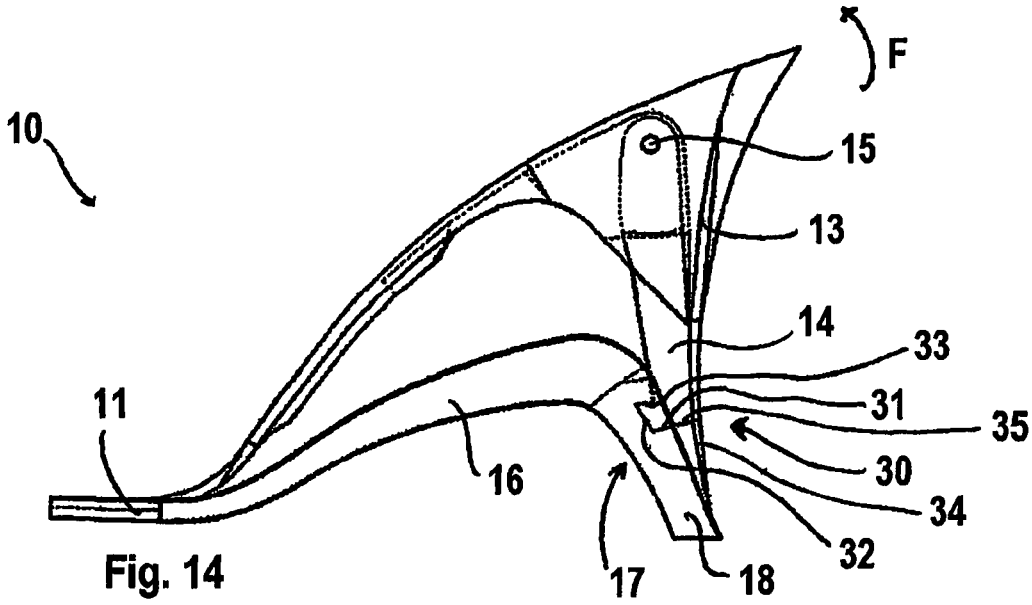
FIG. 14 is a side view of the footwear in FIG. 11.
Figure 15:
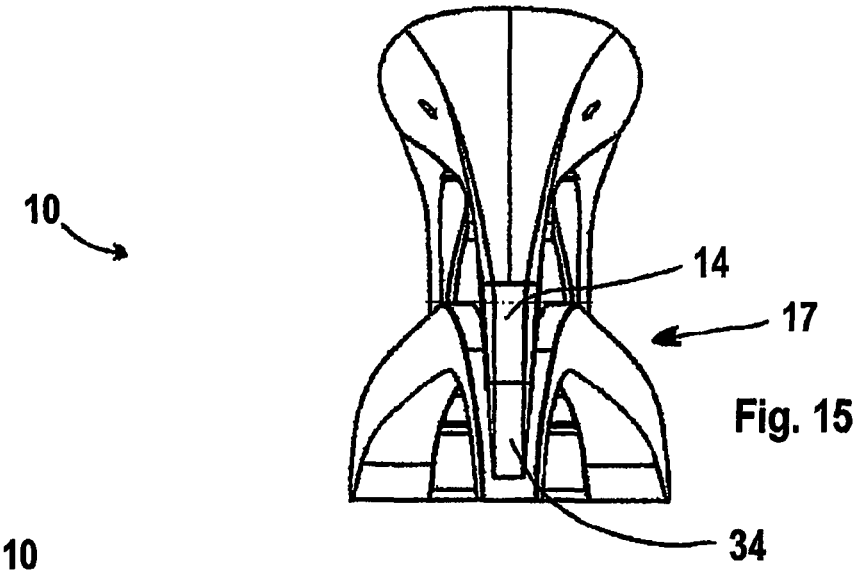
FIG. 15 is another view of the footwear in FIG. 11.
Figure 16:
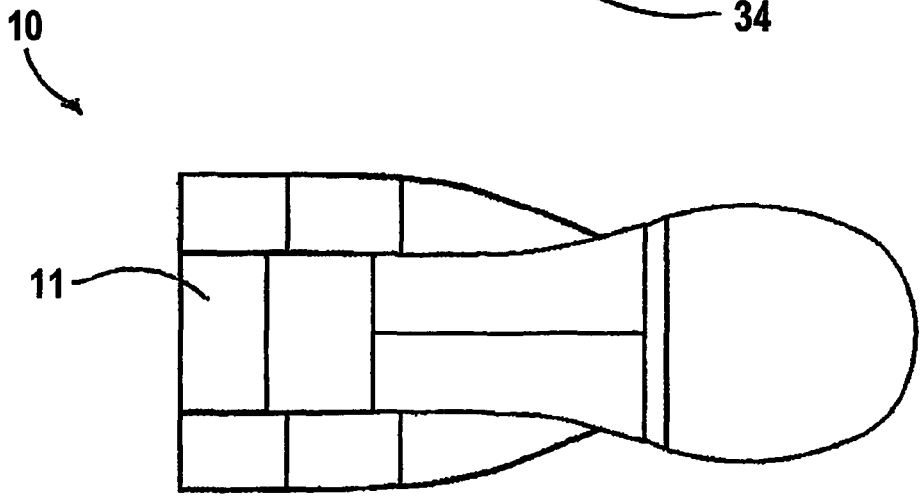
FIG. 16 is a top view of the footwear in FIG. 11.
Figure 17:
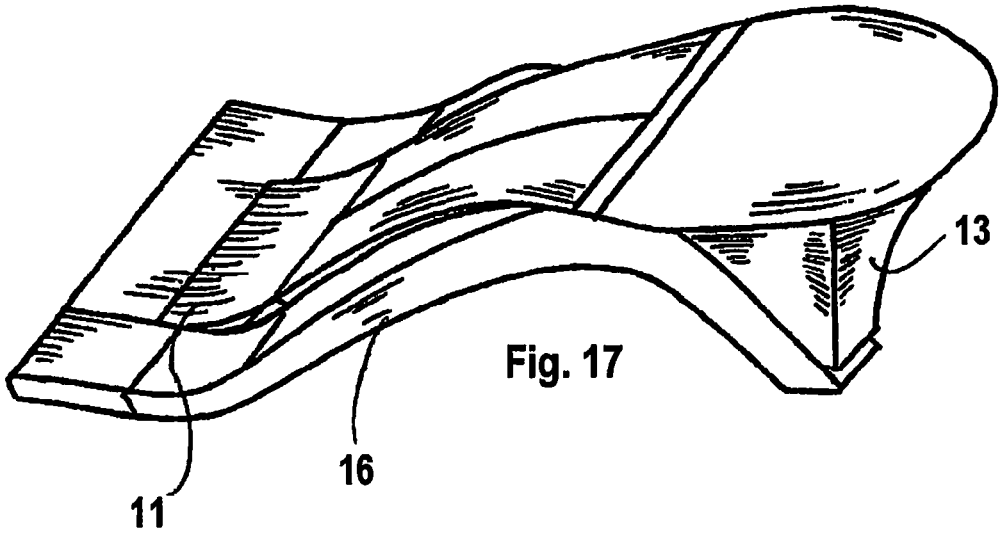
FIGS. 17 to 19 are perspective views of the footwear in FIG. 11 in another use configuration.
Figure 18:
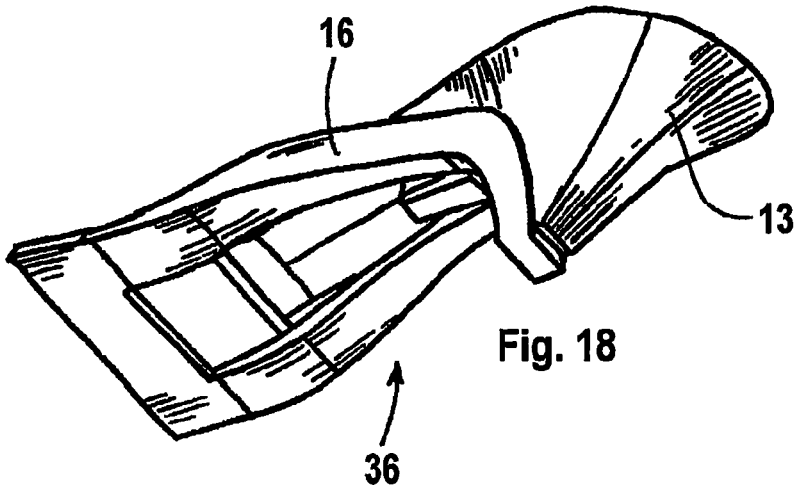
Figure 19:
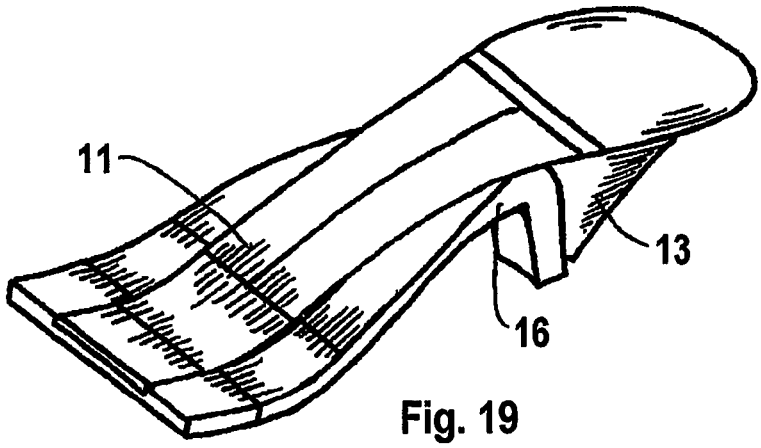
Figure 20:
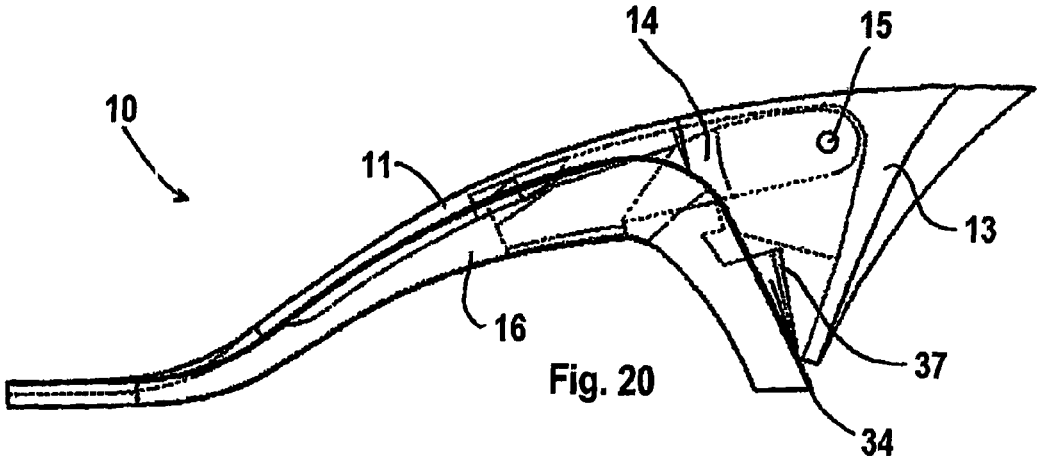
FIG. 20 is a side view of the footwear in FIG. 17.
Figure 21:
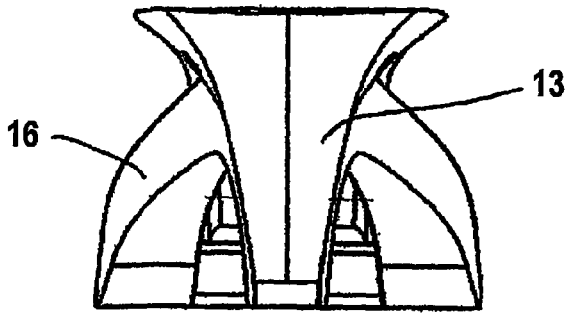
FIG. 21 is another view of the footwear in FIG. 17.
Figure 22:
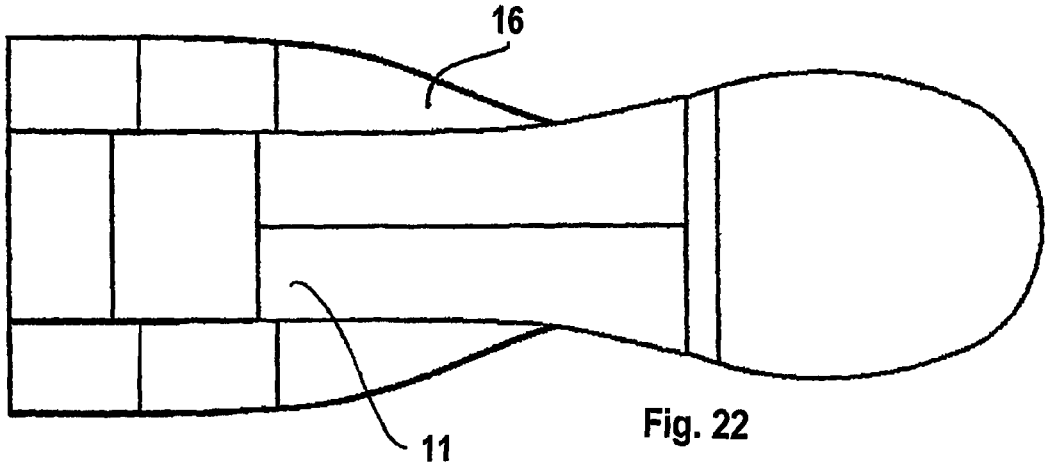
FIG. 22 is a top view of the footwear in FIG. 17.

As better shown in FIG. 14, the second heel portion 14 may provide a connection portion 30 below that protrudes substantially transversely in such a way as to be able to be received in the seat 17, in the walking configuration. In particular, the seat 17 can provide a recessed cavity defined by a first surface 31, on which the second heel portion 14 can rest, a second surface 32, arranged substantially transversely to the first surface 31, and a third surface 33, substantially parallel to the first surface 31. Near the end 18, the arched bridge 16 is provided with a projecting portion 34 provided above with a rest surface 35 on which the second heel portion 14 discharges part of the weight acting on the footwear 10.

Figure 11:
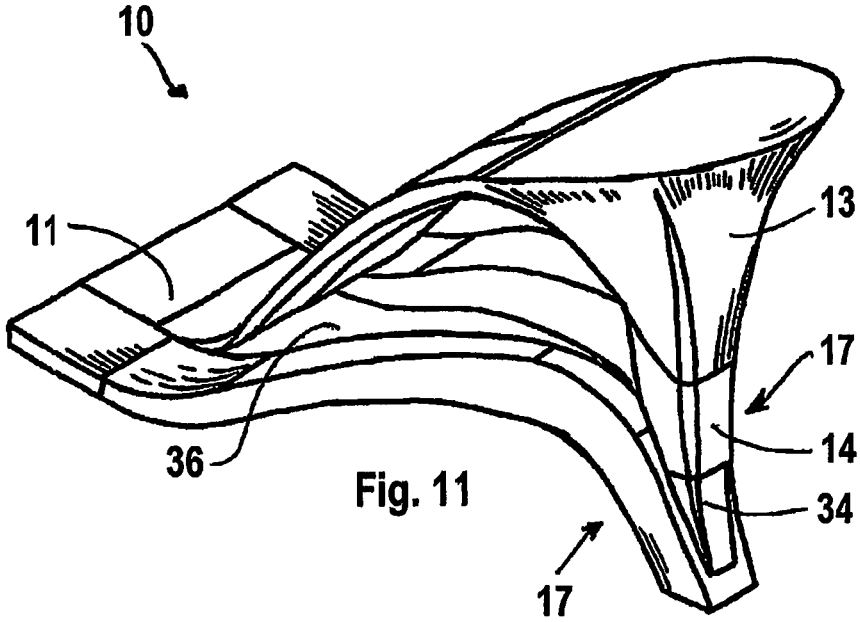
FIGS. 11 to 13 are perspective views of footwear similar to that shown in FIGS. 1 and 2.
Figure 12:
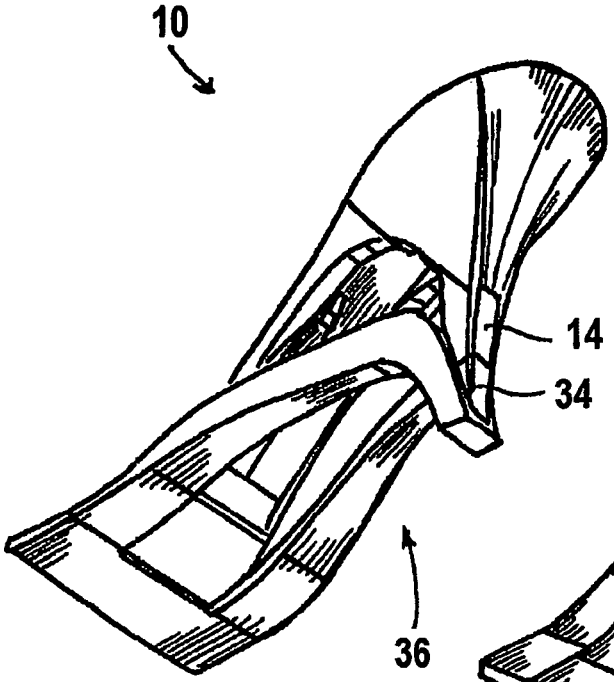
Figure 13:
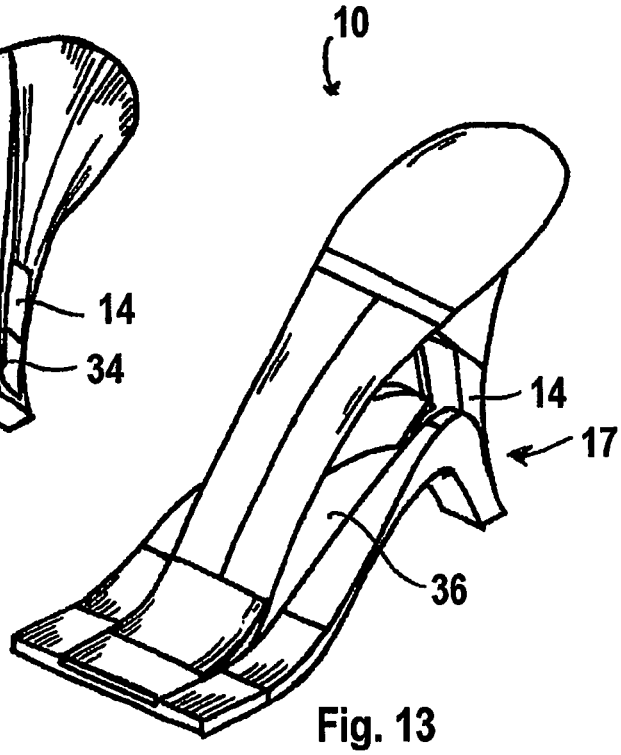

The seat 17 enables the second heel portion 14 and the arched bridge 16 to be kept coupled together by means of a lock joint, which during using of the footwear 10, are subjected to continuous stress. In particular, the third surface 33 prevents the second heel portion 14 from disengaging from the seat 17 if stress occurs that tends to move the arched bridge 16 away from the first heel portion 13. The connection portion 30 can be removed from the seat 17 by elastically flexing the sole 11 in the direction shown by the arrow F. The fork shape enables the internal part of the arched bridge 16, i.e. the zone between the seat 17 and the sector of connection to the sole 11 to be open and this enables the heel, in particular the second heel portion 14, to be raised from the seat and folded inside by rotating on the pin 15 so that it is arranged as seen in FIG. 2, invading, at least partially, the opening 36 of the fork, as better shown in FIGS. 11 to 13.

FIGS. 17 to 22 show the footwear 10 in the rest configuration, in which the second heel portion 14 is rotated to the sole 11, and the first heel portion 13 is arranged in contact with the end 18 of the arched bridge 16. In particular in the first heel portion 13 a connection seat 37 is received, shaped to receive within itself the projecting portion 34. The projecting portion 34 and the connection seat 37 can be shaped in such a way as to obtain a lock joint connection between the first heel portion 13 and the end 18. In this way, in order to connect the latter together, the first heel portion 13 must be pushed against the end 18 at the same time forcing the sole 11 to flex elastically to promote the entry of the projecting portion 34 into the connection seat 37. During use of the footwear 10 in the rest configuration, this enables the first heel portion 13 and the end 18 to be kept connected together in a secure manner.

It can be noted from FIG. 2 that the footwear in the rest position has a shape that is very similar to that of traditional footwear, inasmuch as the sole 11 and the fork 16 have been deliberately designed in such a way that their profiles interlock to form a single body, obtaining an aesthetic effect that is even more appreciable.

It can furthermore be noted that, in a lowered or rest position, the height of the heel has been significantly reduced inasmuch as it is the first heel portion 13 that now rests on the fork 16, enabling the person to use the same footwear in a rest position, with all the advantages that arise therefrom.

In the lowered position, the second heel portion 14 folded inside enables the first heel portion 13 of the footwear and the rear part of the sole to go to rest on the fork 16, giving the sandal a shape and a configuration that is much more comfortable and particularly useful in the rest positions.

In fact, after using the sandal in the position of maximum elevation of the heel, it is possible, once the destination place has been reached, with a simple folding operation inside the second heel portion 14, to return the footwear to the lowered heel position, with considerable lightening of the tensions to which the foot is subjected when it is in the high heel positions.

Figure 3:
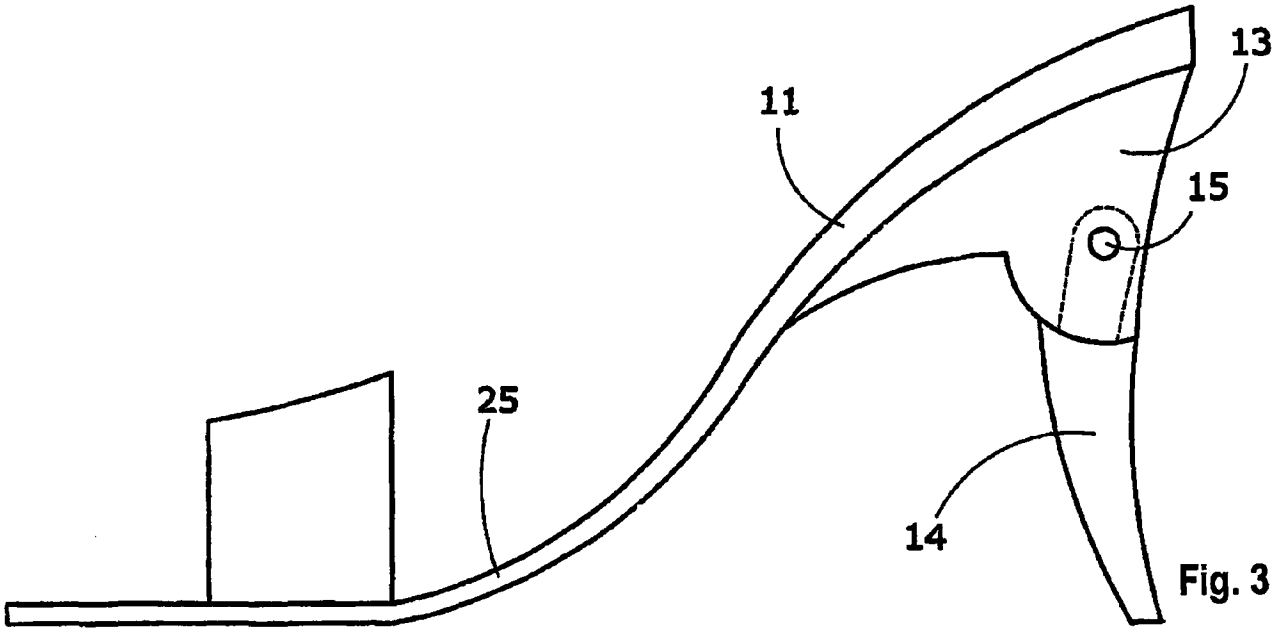
FIG. 3 shows the schematic view of the footwear in which the variable configuration heel is made according to a possible constructional version shown in a raised position.
Figure 4:
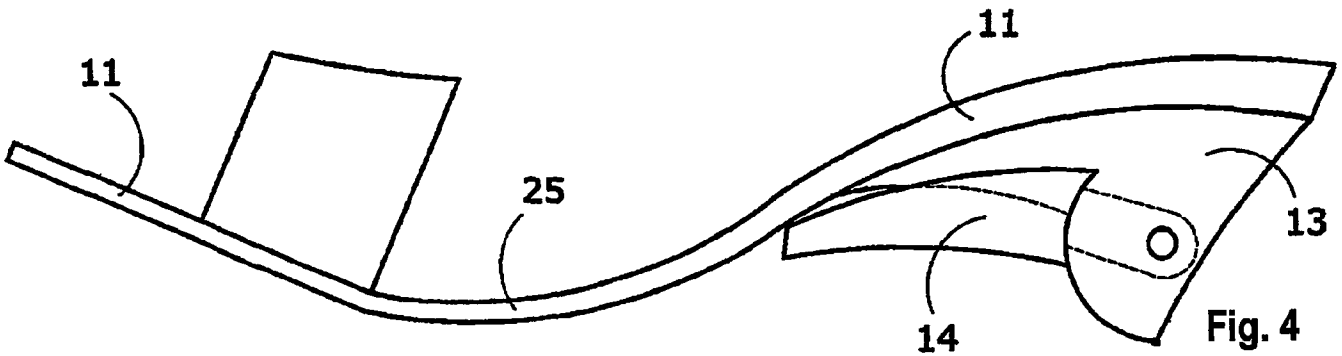
FIG. 4 is the same view as the previous figure but with the heel in a lowered rest position.

The possibility is also provided for that the end of the second heel portion 14 that rests in the seat 17 of the fork 16 may be retained, in a raised position and position of use at maximum height, with a suitable retaining and safety device such as serrations, hooks or other devices that are suitable for the same purpose. In the same way it is also provided for that such safety device is positioned at the articulated joint 15 placed between the first heel portion 13 and the second heel portion 14. According to a further embodiment, it is provided for that the second heel portion 14 instead of being connected with the articulated joint 15 thereof to the first heel portion 13, can for the same purpose be connected to the fork 16, and in this case the coupling zone of the free end would be arranged upwards, i.e. inside the first heel portion 13, according to a simple inversion of the parts. According to a further embodiment, shown in FIGS. 3 and 4, by using the same hinge joining means 15, it is also provided for that the second heel portion 14 can remain in an extended or retracted position without the help of a reinforcing fork.

In this case, the second heel portion 14 rests directly on the ground, whereas in the lowered position the first heel portion 13 possibly provided with a suitable seal, rests on the ground.

Figure 5:
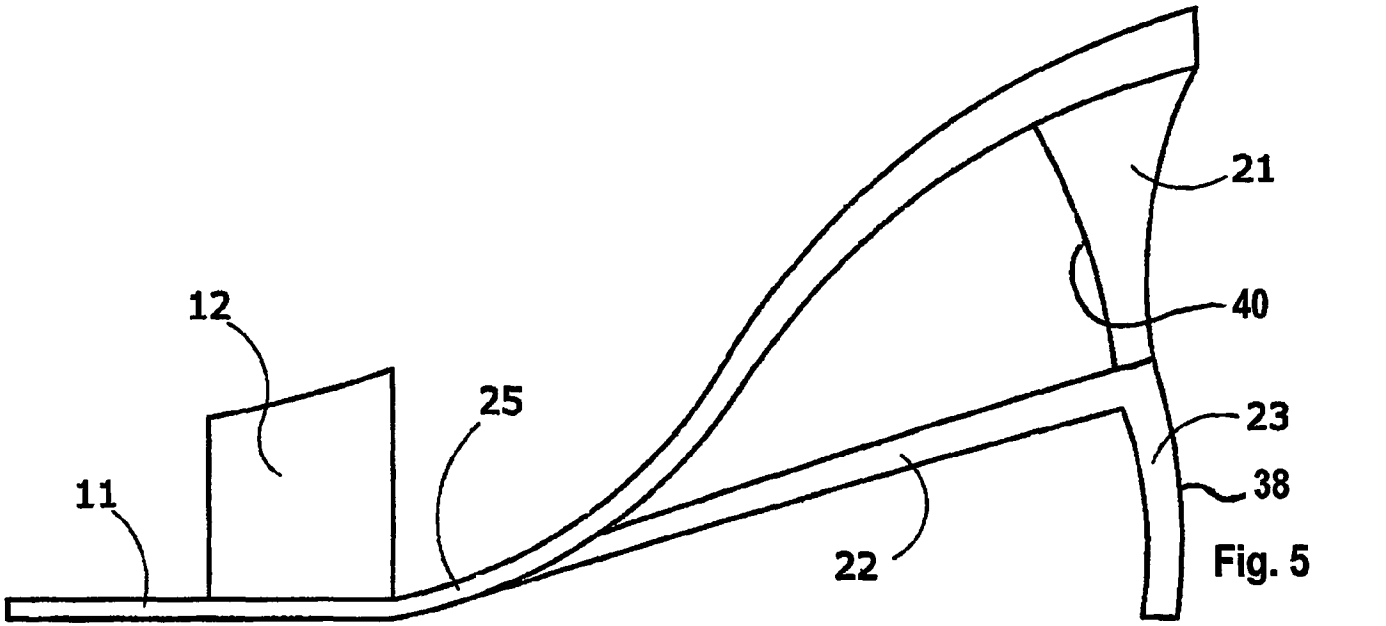
FIGS. 5 and 6 show schematic views of footwear with variable configuration heel in a further constructional form.
Figure 6:
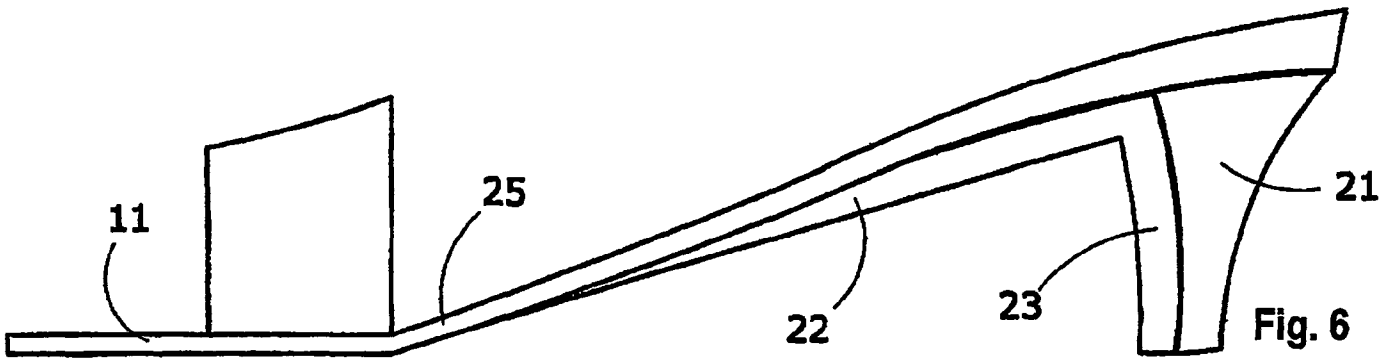
Figure 8:
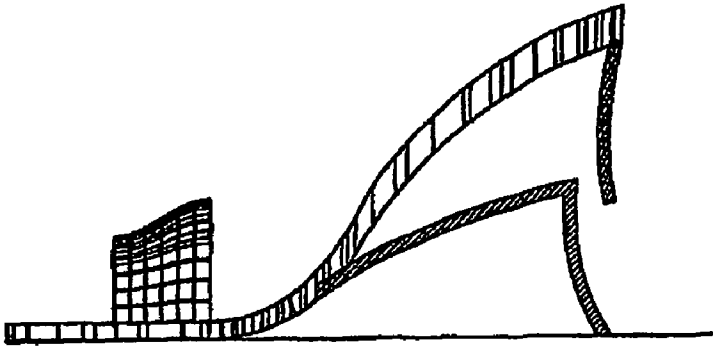
FIGS. 7 to 10 are schematic views showing the modes of use of the sandal with a double heel collaborating with a double sole.
Figure 7:
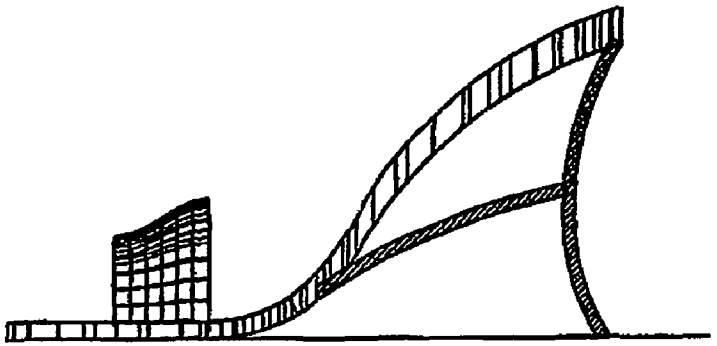
Figure 10:
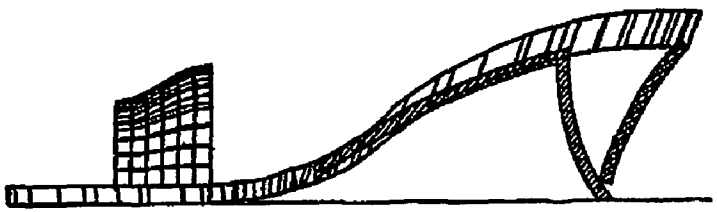
Figure 9:
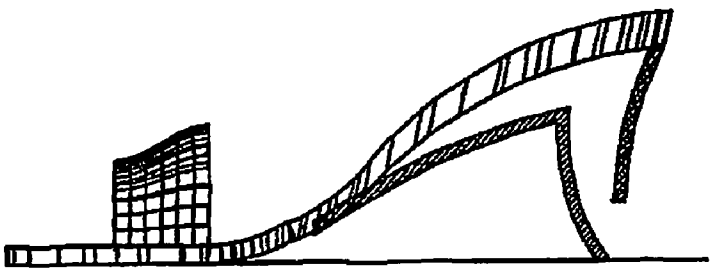

Lastly, according to a further embodiment shown in FIGS. 5 and 6, it is provided for that a heel 21 forms a single body with the sole 11 whilst the end of the heel 21 comes to rest on a lower structure 22 provided with an additional heel 23 connected to the sole 11.

If it is wished to arrange the footwear from the walking configuration shown in FIG. 5 to the rest configuration shown in FIG. 6, the heel 21 must be pulled outside the footwear, away from the uppers 12. In this way the sole 11 is forced to flex by a sufficient amount to enable a lower end of the heel 21 to protrude outside the lower structure 22. Subsequently, the heel 21 is acted upon in such a way as to slide its coupling surface 40 along an external surface 38 of the additional heel 23 until the rest configuration is reached. In order to ensure that the footwear in the rest configuration is stable and secure in the presence of stress that occurs during use, it is possible to ensure that the external surface 38 has, for example, a convex shape and that the coupling surface 40 is shaped in a complementary manner thereto, for example concave. In this way a shaping coupling is obtained between the coupling surface 40 and the external surface 38. The heel 21 can again be moved above the additional heel 23 by acting with certain force on the heel 21 that elastically and momentaneously deforms the sole 11 in such a way that the coupling surface 40, by becoming detached from the external surface 38, can be separated from the latter.

In FIGS. 7 to 10 it is shown how a double-heel shape can cooperate with a double-sole shape. In this case the end of the heel of the upper sole is provided with a connecting arrangement for connecting to the sole and to the lower heel, thus enabling the footwear to ensure the necessary stability and solidity.

In all the disclosed solutions it is provided for that the sandal footwear is provided with a sole softened or made flexible at the central part 25 placed near the rest and metatarsal articulated joint zone of the foot.

In fact flexure of the footwear following variation of the attitude can be corrected with such a contrivance.

It is lastly provided for that the same system with a variable heel can be used, with suitable structural contrivances, also on footwear of the closed type.

In the case of an application to a closed type of footwear, particular attention must be paid to the articulated joint points and to the flexible zones of the footwear, in order to enable correct arrangement in the two positions with a raised or lowered configuration.

The invention has been disclosed above with reference to a possible embodiment thereof.

Nevertheless, it is clear that the invention is open to numerous variations that are technically equivalent in scope.

The invention claimed is:

1. A footwear article, comprising (a) a sole having toe and heel ends;

(b) an adjustable heel including a first heel portion fixed to said sole heel end and a second heel portion rotatably connected with said sole heel end for movement between a first generally vertical active position for supporting a foot and a second generally horizontal inactive position; and (c) a support portion connected with said sole between said toe and heel ends, said support portion including a third heel portion containing an opening for receiving said second heel portion when it is rotated to the inactive position, said support portion being configured to match a curvature of said sole, whereby when said second heel portion is in the active position, it engages said third heel portion to elevate the heel end of said sole above said support portion to form a high heel type of footwear and when said second heel portion is in the inactive position, the heel end of said sole is lowered against said support portion in contiguous relation therewith to form a sandal type footwear.

2. A footwear article as defined in claim 1, wherein said support portion contains a forked third heel portion to define said opening.

3. A footwear article as defined in claim 1, and further comprising a pivot element connected with said first heel portion and arranged transversely to a longitudinal axis of the footwear article for rotatably connecting said second heel portion with said first heel portion.

4. A footwear article as defined in claim 1, and further comprising means for connecting said second heel portion with said third heel portion.

5. A footwear article as defined in claim 4, wherein said connecting means include a seat within said third heel portion for receiving and retaining a lower end of said second heel portion.

6. A footwear article as defined in claim 5, wherein said seat includes a first surface for supporting said second heel portion lower end, a second surface transverse to said first surface, and a third surface spaced from and facing said first surface for locking said second heel portion lower end in said seat.

* * * * *